US008235027B2

(12) United States Patent
Guterres et al.

(10) Patent No.: US 8,235,027 B2
(45) Date of Patent: Aug. 7, 2012

(54) VENT-ON-DEMAND FUEL SUMP AND FUEL SYSTEM HAVING SUCH A FUEL SUMP

(75) Inventors: R. Michael Guterres, Reisterstown, MD (US); James Jeter, New Freedom, PA (US)

(73) Assignee: AAI Corporation, Hunt Valley, MD (US)

( * ) Notice: Subject to any disclaimer, the term of this patent is extended or adjusted under 35 U.S.C. 154(b) by 1235 days.

(21) Appl. No.: 11/984,396

(22) Filed: Nov. 16, 2007

(65) Prior Publication Data

US 2008/0121217 A1 May 29, 2008

Related U.S. Application Data

(60) Provisional application No. 60/859,243, filed on Nov. 16, 2006.

(51) Int. Cl.
*F02M 37/20* (2006.01)

(52) U.S. Cl. ..... 123/516; 123/518; 123/519; 123/520; 123/198 D; 137/587; 137/588; 137/589

(58) Field of Classification Search ..... 123/516, 123/518, 519, 520, 198 D; 137/587, 588, 137/589

See application file for complete search history.

(56) References Cited

U.S. PATENT DOCUMENTS 2,202,197 A * 5/1940 Ewertz ..... 137/554
2,297,238 A 9/1942 Neugenbauer et al.
2,383,369 A 8/1945 Curtis
2,484,690 A * 10/1949 De Giers ..... 338/12
2,609,118 A 9/1952 Cattaneo
2,702,592 A 2/1955 Crampton
2,719,583 A 10/1955 Malick
2,799,848 A * 7/1957 Glantz et al. ..... 137/409
2,857,904 A 10/1958 Eshbaugh
2,870,936 A 1/1959 Clayton
3,272,174 A * 9/1966 Pribonic ..... 340/450.2
3,561,414 A * 2/1971 Schou ..... 123/518
3,586,015 A * 6/1971 Kitzner ..... 137/39
3,586,016 A * 6/1971 Meyn ..... 137/39
3,602,251 A * 8/1971 Hill ..... 137/392
3,794,428 A * 2/1974 Giesecke ..... 356/434
3,937,198 A * 2/1976 Sudhir ..... 123/519
4,244,385 A * 1/1981 Hotine ..... 137/1
4,265,262 A * 5/1981 Hotine ..... 137/2

(Continued)

*Primary Examiner* — Stephen K Cronin
*Assistant Examiner* — Raza Najmuddin
(74) *Attorney, Agent, or Firm* — Venable LLP; Jeffri A. Kaminski; Ryan M. Flandro

(57) ABSTRACT

A vent-on-demand fuel sump and vehicle fuel system having such a fuel sump are provided. The fuel sump may include a pressurized vessel and at least two sensors configured to detect a level of fuel within the vessel. A valve coupled to the vessel may be configured to release air and/or fuel vapor to the atmosphere. The fuel sump may also include a programmable electronic controller configured to modulate the valve between a closed position and an open position based on signals received from the sensors corresponding to the fuel level. The valve may be configured to remain in the closed position until the fuel level drops below a predetermined level and the controller sends a signal to open the valve to release air and/or fuel vapor from the vessel into the atmosphere. The vehicle fuel system having such a fuel sump may include a fuel container and an engine having an intake. The pressurized vessel of the fuel sump may include a fuel inlet coupled to the fuel container and a fuel outlet coupled to the engine intake.

10 Claims, 3 Drawing Sheets

U.S. PATENT DOCUMENTS 4,279,232 A * 7/1981 Schuster et al. ..... 123/516
4,724,705 A * 2/1988 Harris ..... 73/313
4,809,666 A * 3/1989 Baltz ..... 123/516
4,819,607 A * 4/1989 Aubel ..... 123/519
5,119,790 A 6/1992 Olson
5,203,306 A * 4/1993 Billingsley et al. ..... 123/518
5,267,470 A * 12/1993 Cook ..... 73/49.7
5,269,277 A * 12/1993 Kuroda et al. ..... 123/518
5,579,740 A 12/1996 Cotton et al.
5,649,687 A * 7/1997 Rosas et al. ..... 251/129.15
5,730,106 A 3/1998 Gonzalez
5,787,865 A 8/1998 Harris et al.
5,868,120 A 2/1999 Van Wetten et al.
5,913,294 A 6/1999 Takahashi et al.
6,047,720 A * 4/2000 Stein ..... 137/199
6,095,178 A 8/2000 Gilbert et al.
6,230,558 B1 5/2001 Miwa et al.
6,386,222 B1 5/2002 Harris
6,463,965 B1 * 10/2002 Rasche et al. ..... 141/65
6,553,974 B1 * 4/2003 Wickman et al. ..... 123/516
6,584,997 B1 * 7/2003 Blichmann et al. ..... 137/392
6,694,955 B1 * 2/2004 Griffiths et al. ..... 123/516
6,795,598 B1 9/2004 Devenyi
7,011,076 B1 3/2006 Weldon et al.
7,121,301 B2 10/2006 Krogull et al.
7,225,797 B2 * 6/2007 Zdroik ..... 123/516
7,431,021 B1 * 10/2008 Achor ..... 123/520
2002/0185115 A1 * 12/2002 Capshaw et al. ..... 123/518
2002/0189707 A1 12/2002 Enge
2004/0194831 A1 10/2004 Balsdon
2005/0279406 A1 * 12/2005 Atwood et al. ..... 137/39
2006/0048757 A1 3/2006 Harvey
2011/0295482 A1 * 12/2011 Pearce et al. ..... 701/102

* cited by examiner

VENT-ON-DEMAND FUEL SUMP AND FUEL SYSTEM HAVING SUCH A FUEL SUMP

CROSS-REFERENCE TO RELATED APPLICATIONS

This application is related to and claims the priority benefit of U.S. Provisional Patent Application No. 60/859,243, filed Nov. 16, 2006, entitled "Wicking Piccolo Tube For Aircraft Fuel System Bladder," the entirety of which is incorporated herein by reference.

BACKGROUND

1. Field of the Invention

The present invention relates generally to vehicle fuel systems and more particularly to a closed fuel system having a pressurized vessel capable of venting air and/or fuel vapor present in the vessel in a controlled manner.

2. Related Art

Closed (i.e., unvented) fuel systems typically rely on the integrity of the vacuum created and maintained within sealed containers or collapsible bladders to prevent the intrusion of air and/or vapor into the system. Such systems generally do not provide countermeasures to remove internally generated fuel vapor and/or air that enters due to improper fueling or leaks. Accordingly, the total volume of air and/or fuel vapor inside the various components (e.g., fuel bladders, tanks, lines, etc.) of a closed system can reach critical levels capable of progressing through the fuel lines into the engine and thereby inducing engine-seizure.

In contrast, open (i.e., vented) fuel systems typically incorporate a mechanism that allows the removal of undesirable air or fuel-vapor from the fuel lines. Such mechanisms, however, are usually independent from the system fuel sump and are not electronically controlled or modulated based on system conditions. Furthermore, the mechanism may not typically be located immediately before the engine and significant distance between the mechanism and the engine can allow for the intrusion of air through leaks or poorly sealed connections, or additional fuel vapor generated in the lines subsequent to the mechanism, thereby obviating the advantages of an open system.

SUMMARY

In an exemplary embodiment of the present invention a fuel sump and a vehicle fuel system having such a fuel sump are disclosed.

In one embodiment of the present invention, a fuel sump may include a pressurized vessel and at least two sensors configured to detect a level of fuel within the vessel. A valve coupled to the vessel may be configured to release air and/or fuel vapor to the atmosphere. The fuel sump may also include a programmable electronic controller configured to modulate the valve between a closed position and an open position based on signals received from the at least two sensors corresponding to the fuel level. The valve may be configured to remain in the closed position until the fuel level drops below a predetermined level and the controller sends a signal to open the valve to release air and/or fuel vapor from the vessel into the atmosphere.

In another embodiment of the present invention, a vehicle fuel system may include a fuel container and an engine having an intake. The fuel system may include a fuel sump with a pressurized vessel having a fuel inlet coupled to the fuel container and a fuel outlet coupled to the engine intake. The fuel sump may include at least two sensors configured to detect a level of fuel within the vessel and a valve coupled to the vessel. The fuel sump may also include a programmable electronic controller configured to modulate the valve between a closed position and an open position based on signals received from the at least two sensors corresponding to the fuel level. The valve may be configured to remain in the closed position until the fuel level drops below a predetermined level and the controller sends a signal to open the valve to release air and/or fuel vapor from the vessel into the atmosphere.

Further features and advantages of the invention, as well as the structure and operation of various embodiments of the invention, are described in detail below with reference to the accompanying drawings.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION

Figure 1:
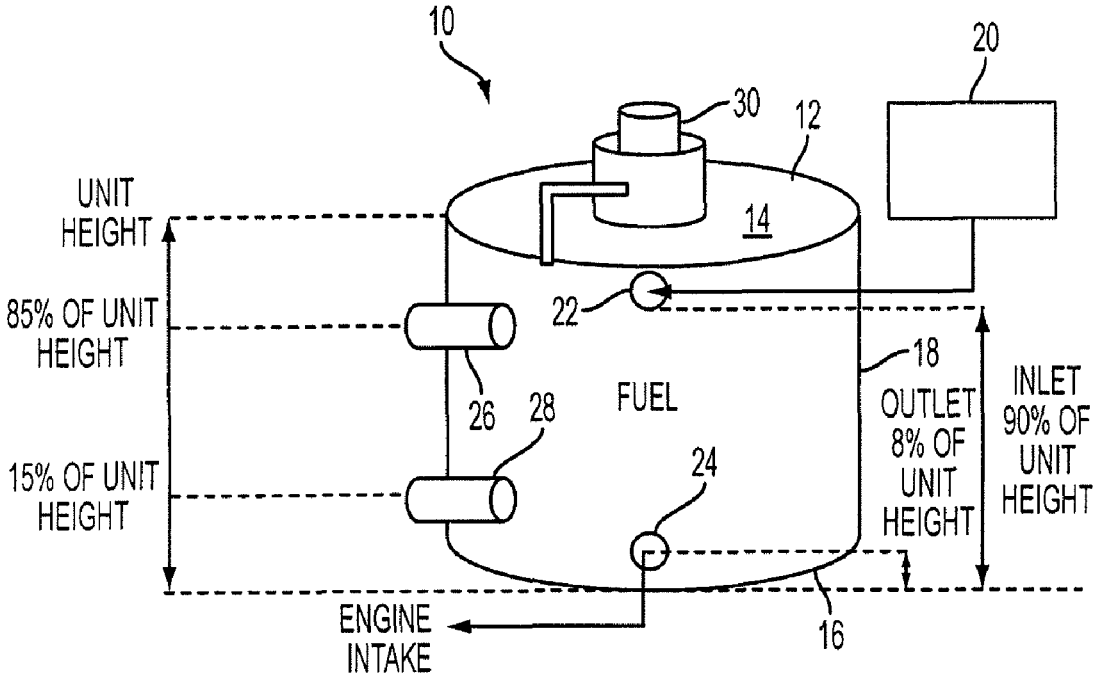
FIG. 1 depicts a schematic view of a fuel sump according to an exemplary embodiment of the present invention.

Various exemplary embodiments of the invention are discussed in detail below. While specific exemplary embodiments are discussed, specific terminology is employed for the sake of clarity. However, the invention is not intended to be limited to the specific terminology so selected and it should be understood that this is done for illustration purposes only. A person skilled in the relevant art will recognize that other components and configurations can be used without parting from the spirit and scope of the invention. Each specific element includes all technical equivalents that operate in a similar manner to accomplish a similar purpose.

In the following description of certain embodiments of the invention, directional words such as "top," "bottom," "upwardly," and "downwardly" are employed by way of description and not limitation with respect to the orientation of the apparatus and its various components as illustrated in the drawings. Similarly, directional words such as "axial" and "radial" are also employed by way of description and not limitation.

Exemplary Definitions

In describing the invention, the following definitions are applicable throughout (including above).

A "computer" may refer to one or more apparatus and/or one or more systems that are capable of accepting a structured input, processing the structured input according to prescribed rules, and producing results of the processing as output.

Examples of a computer may include, e.g., but not limited to: a computer; a stationary and/or portable computer; a computer having a single processor, multiple processors, and/or multi-core processors, which may operate in parallel and/or not in parallel; a general purpose computer; a special purpose computer; a supercomputer; a mainframe; a super mini-computer; a mini-computer; a workstation; a micro-computer; a server; a client; an interactive television; a web appliance; a telecommunications device with internet access; a hybrid combination of a computer and an interactive television; a portable computer; a tablet personal computer (PC); a personal digital assistant (PDA); a portable telephone; application-specific hardware to emulate a computer and/or software, such as, for example, but not limited to, a digital signal processor (DSP), a field-programmable gate array (FPGA), an application specific integrated circuit (ASIC), an application specific instruction-set processor (ASIP), a chip, chips, and/or a chip set; a system on a chip (SoC), or a multiprocessor system-on-chip (MPSoC); an optical computer; a quantum computer; a biological computer; and/or an apparatus that may accept data, may process data in accordance with one or more stored software programs, may generate results, and typically may include input, output, storage, communications, arithmetic, logic, and/or control units, etc.

"Software" may refer to prescribed rules to operate a computer. Examples of software may include, for example, but not limited to: software; code segments; instructions; applets; pre-compiled code; compiled code; interpreted code; computer programs; and/or programmed logic.

DETAILED DESCRIPTION OF AN EXEMPLARY EMBODIMENT

FIG. 1 depicts a schematic view of a fuel sump 10 according to an exemplary embodiment of the present invention. In operation, the fuel sump 10 may provide a "vent-on-demand" feature to selectively remove air and/or fuel-vapor from a fuel system to which the fuel sump 10 may be connected. This may allow a closed-loop fuel system to operate in conditions where the generation of fuel vapor or the intrusion of air can occur in large enough quantities to induce engine seizure. As shown in FIG. 1, the fuel sump 10 may include a pressurized vessel 12 having a top 14, a bottom 16, and a side wall 18 to define an interior volume capable of storing a liquid such as, for example, fuel for direct delivery to an engine (not shown in FIG. 1). The pressurized vessel 12 may also be capable of accumulating air and/or fuel vapor that may be present in the system to which fuel sump 10 is connected. The pressurized vessel 12 may include a fuel inlet 22 and a fuel outlet 24. The fuel inlet 22 may be configured to be coupled to a fuel container or tank 20 which may be, for example, a collapsible bladder. The fuel outlet 24 may be configured to be coupled directly to the engine intake (not shown in FIG. 1). A pair of sensors 26, 28 such as, for example, optical sensors, may be disposed on the pressurized vessel 12 and may be arranged to detect a level of fuel within the vessel 12. In the embodiment depicted in FIG. 1, for example, the pair of sensors may include a first (upper) sensor 26 and a second (lower) sensor 28. One of skill in the art will recognize that the sensors could be any of a number of different types of lightweight sensors such as, for example, but not limited to, capacitance and/or other non-intrusive automotive-type sensors. An exhaust valve 30 may be coupled to the vessel 12 and may be configured to vent or release air and/or fuel vapor that has accumulated in the vessel 12 when predetermined conditions are reached within the vessel 12 as detected by the sensors 26, 28. The exhaust valve 30 may be, for example, a solenoid valve or any other valve that can be activated at a high frequency to allow exhaust without losing pressure in the vessel 12. In one embodiment (not shown), the valve 30 may be connected to a fuel line attached to an aperture in the top 14 of the vessel 12.

As shown in the embodiment depicted in FIG. 1, the vessel 12 may define a total unit height measured from the bottom (base) 16 up to the top 14. The fuel inlet 22 and the fuel outlet 24 may be positioned along the side wall 18 of the vessel 12 such that the fuel inlet 22 is above the fuel outlet 24. In one embodiment, the fuel inlet 22 may be positioned at approximately 90% of the total unit height of the vessel 12 and the fuel outlet 24 may be positioned at approximately 8% of the total unit height of the vessel 12. Similarly, the first and second sensors 26, 28 may be positioned along the side wall 18 of the vessel 12 such that the first sensor 26 is located above the second sensor 28. In the embodiment shown in FIG. 1, the first sensor 26 may be positioned at approximately 85% of the total unit height of the vessel 12 and the second sensor 28 may be positioned at approximately 15% of the total unit height of the vessel 12. The first and second sensors 26, 28 may be angularly offset from the fuel inlet and outlet 22, 24 about a central vertical axis (not shown) defined by the vessel 12 so that fuel entering the vessel 12 via the inlet 22 does not inadvertently contact the sensors 26, 28 and cause a false signal to be generated regarding the conditions within the vessel 12. In the embodiment depicted in FIG. 1, the inlet 22 and outlet 24 may be located 900 off-axis from the sensors 26, 28 to avoid splashing the sensors 26, 28 with incoming fuel and producing false "wet" signals when the vessel 12 is only partially full.

Figure 2:
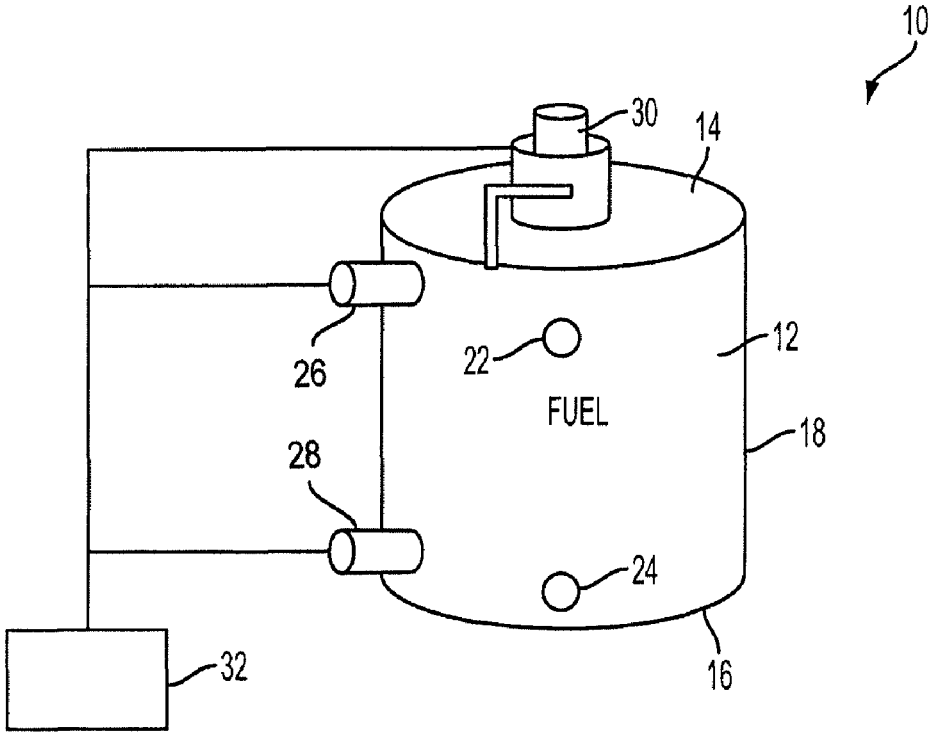
FIG. 2 depicts another schematic view of the fuel sump of FIG. 1 when the fuel sump is completely full of fuel.

FIG. 2 depicts another schematic view of the fuel sump 10 of FIG. 1 when the vessel 12 is completely full of fuel (i.e., no air and/or fuel vapor is present in the vessel 21). Each of the first and second sensors 26, 28, as well as the valve 30 are shown as being electrically coupled to a programmable electronic controller 32. In the depicted embodiment, electrical leads emerging from the sensors 26, 28 and valve 30 may be coupled to the controller 32, which may be a programmable electronic board with an embedded software controller. In general, the programmable electronic controller 32 may be, for example, a computer or other application-specific hardware configured to emulate a computer, and which is capable of receiving input, processing data in accordance with one or more stored software programs, and generating output. The controller 32 may be electrically coupled to the sensors 26, 28 and to the valve 30 by hard-wired connections (e.g., electrical leads and/or wires, coaxial cable, twisted pair, optical fiber, and/or waveguides, etc.) and/or wireless connections (e.g., radio frequency waveforms, free-space optical waveforms, and/or acoustic waveforms, etc.).

Figure 3:
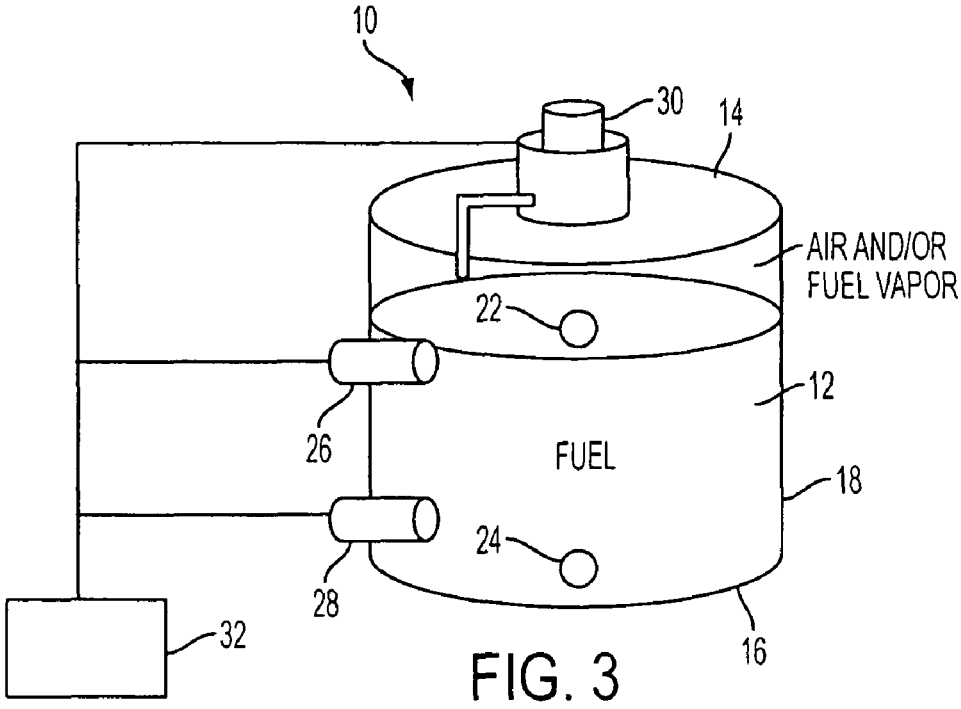
FIG. 3 depicts another schematic view of the fuel sump of FIG. 1 when the fuel sump is partially full of fuel.
Figure 4:
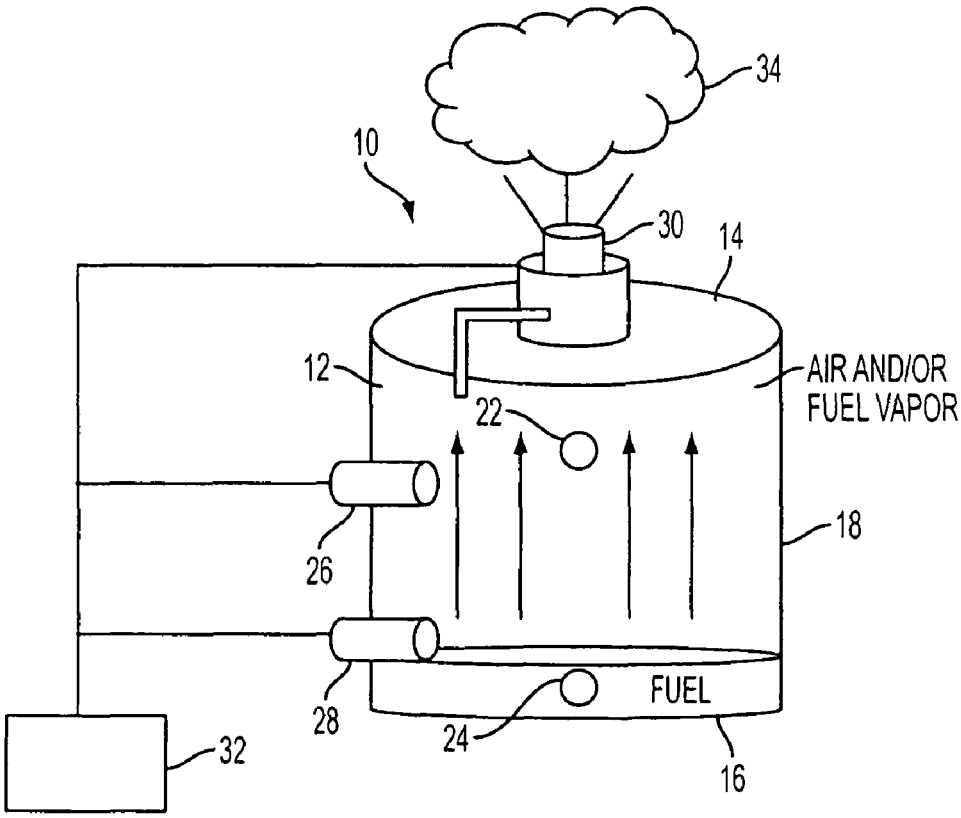
FIG. 4 depicts another schematic view of the fuel sump of FIG. 1 when the fuel level in the sump is at a critical level and air and/or fuel vapor is vented from the sump.

FIGS. 2-4 depict the fuel sump 10 in various states depending on the level of fuel within the vessel 12. In any given state, the sensors 26, 28 may output signals to the controller based on the level of fuel in the vessel 12. The controller 32 may receive and process the logical on/off signals from the sensors 26, 28 and may determine the appropriate position of the valve 30 for the particular state detected in the vessel 12. The controller 32 may include software configured to vary the on/off cycle time of the valve 30 to achieve a pulsed activation that can increase or decrease the time required to expel the volume of air and/or fuel vapor in the vessel 12. An example logic table of the controller 32 is shown below in Table 1:

TABLE 1

| Solenoid Valve Controller Logic | | |
|---|---|---|
| Top Sensor | Lower Sensor | Action |
| Wet | Wet | Volume Filled with fuel, Solenoid Off |
| Dry | Wet | Fuel Level Dropping Below First Sensor; Second OK, Solenoid Off |
| Wet | Dry | Sensor Malfunction, Either Lower Off or Top Stuck On, Solenoid Locked "Off" |
| Dry | Dry | Fuel Level Low, Activate Solenoid Valve Until Both Sensors Wet |

In FIG. 2, the vessel 12 is shown as being completely full of fuel, i.e., prior to any air or fuel vapor intrusion into the system. In this state, sensors 26 and 28 may both return signals of "wet" to the controller 32 and the valve 30 remains closed. After time, air and/or fuel vapor may be present in the system and enter the pressurized vessel 12. The air and/or fuel vapor may buoyantly accumulate along a direction perpendicular to the gravity gradient (the top 14 in equilibrium flight), thereby displacing the fuel volume. When the vessel 12 is partially full of fuel, as shown in FIG. 3, the vessel 12 may contain some volume of air and/or fuel vapor in addition to the fuel. In FIG. 3, the fuel level shown is sufficient to cover both sensors 26, 28 and, as a result, both sensors 26, 28 may return signals of "wet" to the controller 32 and the valve 30 remains closed. Even when the fuel level drops below the first (upper) sensor 26 and the controller receives a signal of "dry" from the first (upper) sensor 26, the valve 30 may remain closed so long as the second sensor 28 still returns a signal of "wet".

As shown in FIG. 4, the air and/or fuel vapor may continue to accumulate in the vessel 12 until the displacement of fuel causes the second (lower) sensor 28 to return a "dry" signal to the controller 32, resulting from a loss of fuel covering the sensor 28. At this point, the fuel level in the vessel 12 has dropped to a critical level and both sensors 26, 28 may return a signal of "dry" to the controller 32. The controller 32, in turn, may output a signal to the valve 30 to open and air and/or fuel vapor may be vented from the vessel 12 through the valve 30. In an exemplary embodiment in which the valve 30 is a solenoid valve, the signal from the controller 32 may charge the inductor, opening the solenoid valve for an amount of time determined by the controller 32. The positive pressure inside the vessel 12 may cause the air and/or fuel vapor to eject through the valve 30, thereby allowing incoming fuel to fill the evacuated volume of the vessel 12. Fuel may continue to flow into the vessel 12 through the inlet 22 until both sensors 26, 28 are immersed in fuel and return "wet" signals to the controller 32 indicating a full fuel volume within the vessel 12. The valve 30 may be controlled to ensure near constant pressure in the vessel 12 (e.g., by pulse width modulated timing of the valve 30). The fuel sump 10 may ensure reliable fuel delivery to a carburetor or injector of an engine at any throttle position.

As shown in Table 1, failure modes may also be addressed in the controller's logic and safe-guards may be implemented to accommodate different failure modes of the system. The first safe-guard may relate to the signals received from the first and second sensors 26, 28. For example, the sensors 26, 28 may be designed to return "wet" signals only when on or in the presence of fuel and "dry" signals only when off or in the absence of fuel. In the event that the first (upper) sensor 26 returns a signal of "wet" and the second (lower) sensor 28 returns a signal of "dry," the controller 32 may recognize that one or both of the sensors 26, 28 are malfunctioning and the valve 30 may default to a closed position. When sensor failure is detected, the valve 30 may be shut off and the system may operate as a closed (unvented) system preventing fuel ejection due to failure. In an exemplary embodiment where the fuel sump 10 is used in an aircraft fuel system, sealing the valve 30 for the remainder of a flight after detecting a sensor malfunction may prevent the potential release of fuel during flight.

Another safe-guard may include a time-out sequence in the controller software to prevent the valve 30 from remaining on when receiving false "dry" signals from the sensors 26, 28. This logic may compensate for a possible fault in the sensors 26, 28 that may indicate that the vessel 12 is empty when it is actually full of fuel. The controller 32 may place a time-limit on the maximum duration the valve 30 may remain open. The valve 30 may be instructed to close after a maximum time limit that, if reached, may indicate that a fault exists within the system and the valve 30 may be permanently shutoff. This may return the fuel-system to a closed system with no damage or impact to fuel system performance. In addition, the controller 32 may provide a software warning based on the time and frequency of valve open conditions. In an exemplary embodiment where the fuel sump 10 may be included in a aircraft fuel system, an operator can receive a return home warning in such conditions.

Figure 5:
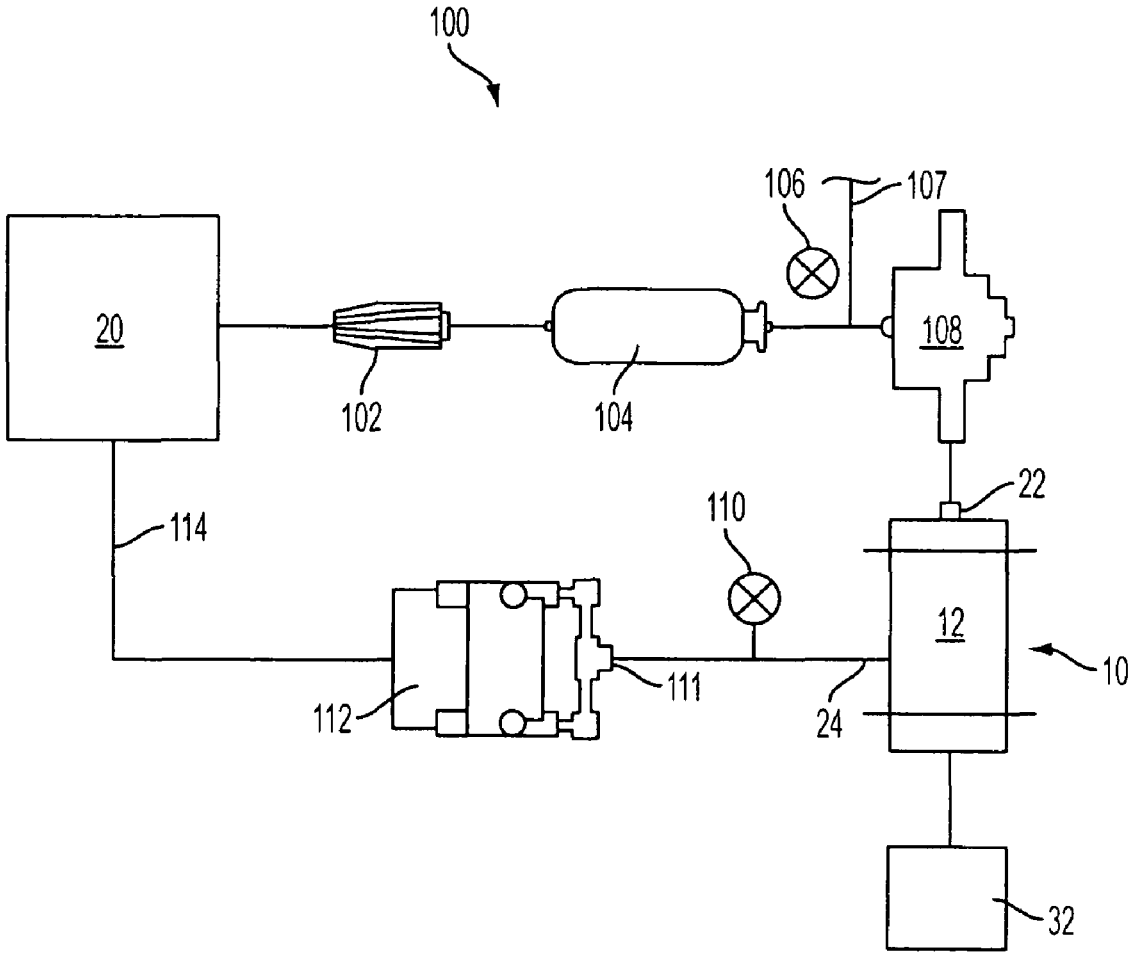
FIG. 5 depicts a schematic view of a fuel system including a fuel sump according to an exemplary embodiment of the present invention.

FIG. 5 depicts a schematic view of a vehicle fuel system 100 incorporating the fuel sump 10 according to an exemplary embodiment of the present invention. Fuel may be initially received and stored in a fuel container or tank 20 such as, for example, but not limited to, a collapsible bladder. When the vehicle is started, fuel may be pulled from the fuel tank 20 through a filter 102 by a fuel pump 104. A pressure gauge 106 may monitor the fuel pressure at an outlet of the pump 104 and air may be injected via line 107 prior to a pressure regulator 108. The fuel sump 10 may receive the fuel after it has passed through the regulator 108 and may function as substantially set forth above based on the controller 32. The sump 10 may operate aft of a pressure regulator 108 to allow a constant higher than atmospheric internal pressure in the vessel 12. Fuel may be drawn directly from the outlet 24 of the vessel 12 to the intake 111 of an engine 112. The sump 10 may be located immediately prior to the engine intake 111 to minimize the possibility of air and/or fuel vapor intrusion between the sump 10 and the engine 112 and allow for maximum effectiveness and efficiency. A pressure gauge 110 may monitor the fuel pressure at the outlet 24. Fuel may return to the tank 20 via return line 114. The ability of the controller 32 to vary the ejection time of air and fuel vapor by varying the open/closed timing of the valve 30 may allow manipulation of the ejection rate of air or fuel vapor. Each component of the fuel system 100 may be lightweight and/or miniature so as to be ideal for use on aircraft.

One of ordinary skill in the art will recognize that the optimum size, shape, and material of the vessel 12 may depend on chosen system characteristics and variables. In one embodiment, the vessel 12 may be composed of an acrylic and/or composite material. One of skill in the art will also recognize that additional valves and/or sensors could be employed.

The fuel sump and any fuel system incorporating such a fuel sump may be adapted for use in a closed vehicle fuel system with, for example, a collapsible bladder and an Electronic Fuel Injection (EFI) equipped engine. EFI high pressure injectors are generally incompatible with closed fuel systems because the injectors are generally less intolerant to air or vapor, which can cause immediate engine seizure. The exemplary fuel sump described herein may permit the coupling of the two technologies by ensuring clean fuel delivery to the injectors under all conditions.

While various exemplary embodiments of the present invention have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. A vehicle fuel system comprising:

a fuel container;

an engine having an intake; and a fuel sump comprising:

a pressurized vessel having a fuel inlet coupled to the fuel container and a fuel outlet coupled to the engine intake;

at least two sensors configured to detect a level of fuel within the vessel;

a valve coupled to the vessel;

a programmable electronic controller configured to modulate the valve between a closed position and an open position based on signals received from the at least two sensors corresponding to the fuel level, wherein the valve remains in the closed position until the fuel level drops below a predetermined level and the controller sends a signal to open the valve to release air and/or fuel vapor from the vessel into the atmosphere.

2. The fuel system according to claim 1, wherein the valve is a solenoid valve.

3. The fuel system according to claim 2, wherein the programmable electronic controller comprises a computer processor for executing a software program, the software program containing code segments configured to pulse width modulate the solenoid valve with asymmetric frequency based on the signals received from the at least two sensors.

4. The fuel system according to claim 1, wherein the vessel includes a top, a bottom, and a sidewall portion, the valve being disposed in the top, and wherein the vessel defines a total height measured from the bottom to the top.

5. The fuel system according to claim 4, wherein the at least two sensors comprise first and second sensors disposed between the top and the bottom along an interior of the sidewall portion, wherein the first sensor is positioned at approximately 85% of the total height of the vessel and the second sensor is positioned at approximately 15% of the total height of the vessel.

6. The fuel system according to claim 4, wherein the inlet and the outlet are respectively positioned at approximately 90% and 8% of the total height of the vessel.

7. The fuel system according to claim 6, wherein the inlet and the outlet are angularly offset from the first and second sensors along the sidewall portion.

8. The fuel system according to claim 1, wherein, in the event at least one of the at least two sensors and/or the controller fails, the valve defaults to the closed position.

9. The fuel system according to claim 1, wherein the at least two sensors comprise optical sensors.

10. The fuel system according to claim 1, wherein the outlet of the fuel sump is connected directly to the engine intake.

* * * * *